United States Patent [19]

Rohatgi et al.

[11] Patent Number: 4,946,647

[45] Date of Patent: Aug. 7, 1990

[54] PROCESS FOR THE MANUFACTURE OF ALUMINUM-GRAPHITE COMPOSITE FOR AUTOMOBILE AND ENGINEERING APPLICATIONS

[76] Inventors: Pradeep K. Rohatgi; Tapan K. Dan; Arya, S. C.; S. V. Prasad; Das, S.; A. K. Gupta; B. K. Prasad; Amol K. Jha, all of Regional Research Laboratory, Bhopal, Madhaya Pradesh, India

[21] Appl. No.: 190,024

[22] Filed: May 4, 1988

[30] Foreign Application Priority Data

Aug. 28, 1987 [AU] Australia ..... 77685/87

[51] Int. Cl.[5] ..... C22C 1/10

[52] U.S. Cl. ..... 420/528; 75/10.45; 75/684; 420/529; 420/534; 420/537

[58] Field of Search ..... 75/68 R, 10.45; 420/528, 529, 534, 537

[56] References Cited

U.S. PATENT DOCUMENTS 3,854,934 12/1974 Dore et al. ..... 75/68 R
4,383,970 5/1983 Komuro et al. ..... 420/528
4,748,001 5/1988 Banerji et al. ..... 75/68 R

OTHER PUBLICATIONS

British Standards Institution, "Specification for Aluminium and Metric Units Aluminium Ingots and Castings", BSI-1490-1970, UDC-66971-412-14.

Indian Standards Institution, "Comparison of Indian and Overseas Standards on Aluminium Alloy Castings", Jan. 1985.

*Primary Examiner*—Melvyn J. Andrews

*Attorney, Agent, or Firm*—Abelman, Frayne, Rezac & Schwab

[57] ABSTRACT

A process is disclosed for the manufacture of aluminium-graphite particulate composite using uncoated graphite particles for automobile and engineering applications. In the process the aluminium-alloy melt is treated with a reactive metal to increase the wettability of the alloy and the graphite particles. Further treatment of the melt and gradual addition of activated graphite powder and stirring at about 500 to about 600 r.p.m. at a temperature of about 700° to about 720° C. result in the composite.

12 Claims, 1 Drawing Sheet

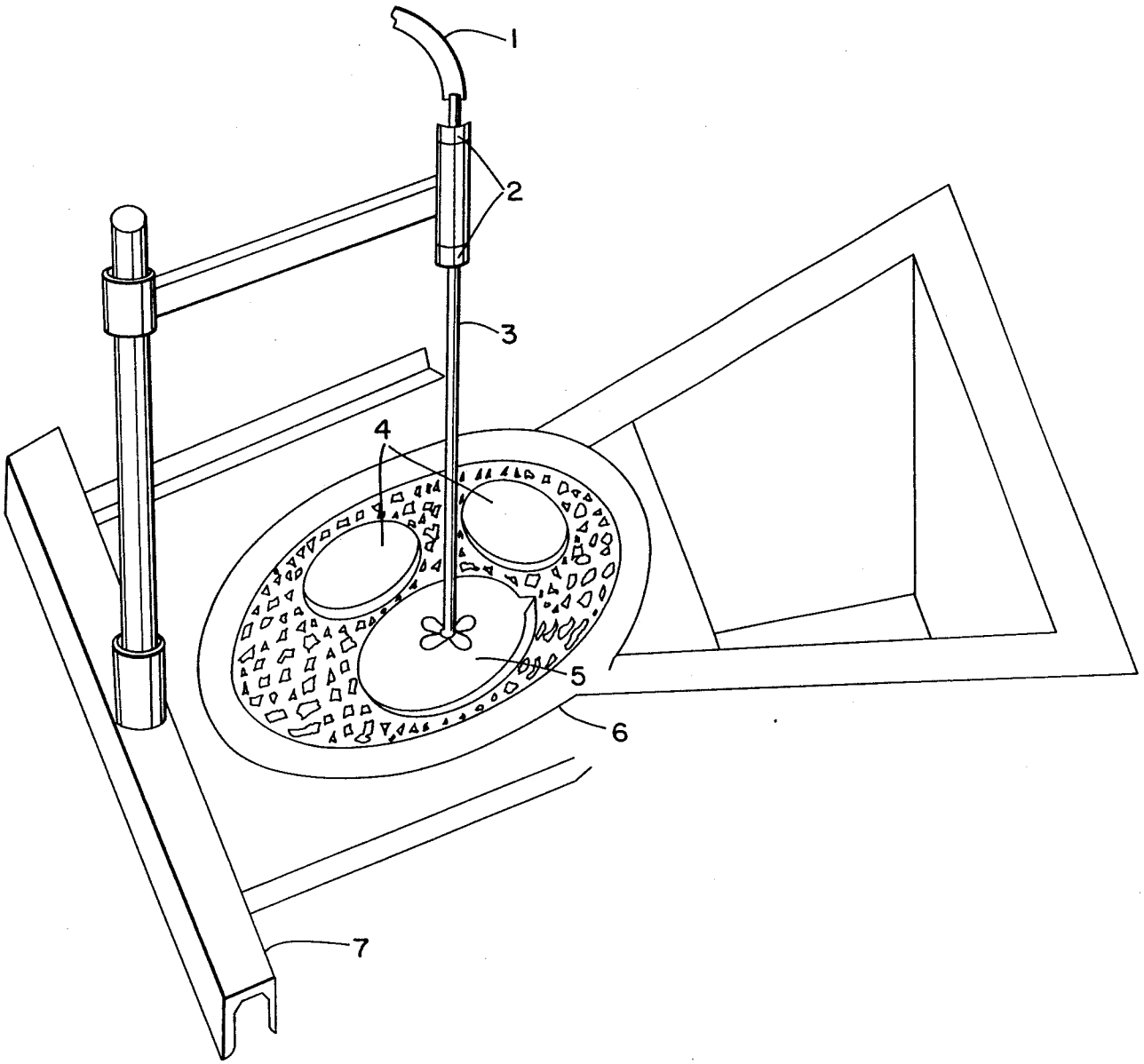
1
2
3
4
5
6
7

PROCESS FOR THE MANUFACTURE OF ALUMINUM-GRAPHITE COMPOSITE FOR AUTOMOBILE AND ENGINEERING APPLICATIONS

This is an invention relating to a process for the manufacture of Aluminium-Graphite composite for automobiles and engineering applications.

Composite materials refer to a combination of several materials which provide unique combination of properties that cannot be realized by the individual constiuents acting alone. Composite materials offer many improvements over the base materials, properties such as bearing, lubricating, damping and machinability can be appreciably enhanced.

Aluminium and its alloys are extensively used in a large number of industrial application due to their excellent combination of properties, e.g. high strength to weigth ratio, good corrosion resistance, better thermal conductivity, easy to deform etc. Because of high strength to weight ratio, automobile and aircraft components are generally manufactured out of aluminium alloys in order to make the moving vehicle lighter, which results in saving in fuel consumption. However, the use of aluminium alloys as an antifriction material has been limited because of unfavourable wear. They tend to seize when run under boundary lubrication condition. To circumvent the above limitation i.e. to improve wear resistance, it has been proposed to disperse graphite particles in aluminium matrices. This will not only increase wear resistance, but will also ameliorate damping capacity and machinability of the base alloy.

Graphite is well known as a solid lubricant and its pressence in aluminium alloy matrices makes the alloys, self-lubricating. The reason for the excellent tribological properties of graphitic aluminium is that aluminium alloy matrix yields at low stresses and deforms extensively which enhances the deformation and fragmentation of the surface and sub-surfaace graphite particles even after short running-in period. This provides a continuous film of graphite on the mating surfaces which, essentially, prevents metal to metal contact and hence prevents seizure. However, the basic problem associated with the production of aluminium-graphite composite is that the graphite particle is not wetted by the aluminium melt. Hence, for the successful entry of the graphite particles into the aluminium melt, either wettability should be induced or sufficient energy must be supplied to allow these particles to overcome the energy barrier at the gas-liquid interface.

Initial efforts confirmed that the graphite particles could not be readily introduced into molten aluminium either by manually plunging or by injection below the bath surface. However, after a series of experiments and constant efforts, the conditions for wetting between graphite particles and aluminium melt have been evolved. The ultimate aim of the present investigation was to induce wetting between graphite particle and aluminium alloy melt using simple liquid metal technology and to develop potential components for automobile and engineering applications.

Dispersion of graphite particles in aluminium melt can be achieved only when the particles are wetted by molten aluminium. In case the particles are not wetted, they remain floating on the top surface of molten metal maintaining separate identity. Initial attempts of producing aluminium-graphite composites have been restricted to the use of coated graphite particles either by nickel or by copper. Coating on graphite particles increases the surface energy and hence reduces the energy for complete immersion of a single graphite particle into the melt. This renders the process costlier and cumbersome and also limits the size of the heat. However, the process, described in this invention has successfully dispersed uncoated graphite particles in aluminium matrices. It has been up-scaled to the level of commercial heats and castings of intricate shapes have been successfully made on quality and quantity basis. Additionally, the inclined and off-centre stirrer, which has been advocated in the initial experiments, has been replaced by vertical centrally located stirrer. This adds to the advantages of using standard graphite crucible.

The aluminium-graphite composite melt has been successully cast using shell moulding, gravity and pressure die casting techniques. In die-casting, solidification is reasonably rapid and multidirectional and there is limited time for undesirable floating of the graphite particles due to lower density as compared to the aluminium melt.

Aluminium and aluminium alloys like Aluminium-Silicon, (Eutectic, Hypo and Hyper), Aluminium-copper, Aluminium-silicon-copper , Aluminium-magnesium, Aluminium-Silicon-Magnesium, Aluminium-Silicon Magnesium-Copper form the base material for the composites. They are avialable in the open market covered by IS, BS and ASTM specifictions. Properties of the composite can be made to suit the required specifications by the proper selection of the base alloy and the percentage of graphite to be added.

Exemplary of the aluminium alloys which can be employed in accordance with the present invention are those listed in Table-1 below. The eight (8) alloy designations bearing the prefix LM, denote designations adopted by the British Standards Institution pursuant to specification No. B.S. 1490.

TABLE 1

| Alloy Designation | Si | Fe | Cu | Mn | Mg | Cr | Co | Zn | Ti | Ni | Al | Others |
|---|---|---|---|---|---|---|---|---|---|---|---|---|
| LM 0 | 0.03 | 0.40 | 0.03 | 0.03 | 0.03 | — | — | 0.07 | — | 0.03 | balance | 0.03 Pb, 0.03 Sn |
| LM 4 | 4.0 to 6.0 | 0.8 | 2.0 4.0 | 0.2 to 0.6 | 0.15 | — | — | 0.5 | 0.2 | 0.3 | balance | 0.1 Pb, 0.1 Sn |
| LM 6 | 10.0 to 13.0 | 0.6 | 0.1 | 0.5 | 0.1 | — | — | 0.1 | 0.2 | 0.1 | balance | 0.1 Pb 0.05 Sn |
| LM 10 | 0.25 | 0.35 | 0.1 | 0.1 | 9.5 to 11.0 | — | — | 0.10 | 0.2 | 0.1 | balance | 0.05 Pb, 0.05 Sn |
| LM 13 | 10.0 to 12.0 | 1.0 | 0.7 to 1.5 | 0.5 | 0.8 to 1.5 | — | — | 0.5 | 0.2 | 1.5 | balance | 0.1 Pb, 0.1 Sn |
| LM 16 | 4.5 to 5.5 | 0.6 | 1.0 to 1.5 | 0.5 | 0.4 to 0.6 | — | — | 0.1 | 0.2 | 0.25 | balane | 0.1 Pb, 0.05 Sn |
| LM 29 | 22.0 to 25.0 | 0.7 | 0.8 to 1.3 | 0.6 | 0.8 to 1.3 | 0.6 | 0.5 | 0.2 | 0.2 | 0.8 to | balance | 0.1 Pb, 0.1 Sn |

TABLE 1-continued

| Alloy Designation | Si | Fe | Cu | Mn | Mg | Cr | Co | Zn | Ti | Ni | Al | Others |
|---|---|---|---|---|---|---|---|---|---|---|---|---|
| LM 30 | 16.0 to 18.0 | 1.1 | 4.0 to 5.0 | 0.3 | 0.4 to 0.7 | — | — | 0.2 | 0.2 | 0.1 | balance | 0.1 Pb, 0.1 Sn |

Graphite electrode manufacturers are the potential source of graphite. It consists of graphite shavings obtained from their machine shops which are crushed and seived to required grain size about (-125 +63 μm). Petroleum coke is the main raw material for electrode manufactures which is blended with pitch and contaminated with coke on the surface during the process of electrode manufacture. The contaminated coke surface gets machined off during machining operation. Thus machine shop returns have certain percentage of pitch and coke mixed with it. It is essential that these two impurities are removed before graphite is added to molten aluminium. To achieve this, seived graphite is heated upto about 900° C. and maintained at this temperature for about 2 hours before dispersing in the melt. It should be stirred now and then, during this period.

it is also possible to make composite with natural graphite. It is flaky in nature. For this reason bouyancy on the natural graphite particles is higher than on synthetic graphite particles.

Accordingly, the present invention provides a process for the manufacture of aluminium-graphite particles composite using uncoated graphite particles for automobile and engineering applications which comprises melting aluminium alloy in a furnance, addign a flux to cover the melt to remove slag and impurities ad to prevent absorption of moisture, treating the melt with a reactive metal to increase the wettability of the alloy and the graphite particles, mixing the melt for proper distribution of the reactive metal, cleaning and degassing the melt with dry nitrogen, treating the melt with flux again and cleaning, gradually adding the surface activated graphite powder to the bath and stirring at about 500 to 600 r.p.m. at a temperature of about 700° to about 730° C.

Furnace used in the present case is a coke fired pit furnace. The schematic view of the furnace employed is given in FIG. 1 of the accompanying drawings wherein the numerals refer to the following:

(1) Flexible Shaft
(2) Bearings
(3) Mild Steel Stirrer
(4) Graphite pre-heating crucible
(5) Melting crucible
(6) Mild Steel Frame
(7) Pit Furnace It can be either an oil fired or an electric furnace as well. As shown graphite crucibles have been used in the process —A-150 for melting the alloy and A-6 for preheating graphite powders.

The invention is described in detail below: To start with, the main crucible for melting aluminium alloy is placed in the furnace and the small crucibles for preheating graphite powder are arranged on its side. Weighed amounted of graphite powder is place in the crucible and covered with a lid. As soon as the melting crucible is heated up, weighed amount of aluminium alloy is charged and crucible is covered. When aluminium has reached a semi-pasty stage, its surface is covered with a fluxing agent. The preferred fluxing agent is Coveral-11 which is marketted by M/s Foseco Greaves. Other commercially available fluxing agents can also be used.

No sooner, the temperature rises to about 700° C, the cover flux is worked into the metal with the help of a spoon kept ready coated with a refractory layer. The slag is pushed aside a small amount of reactive metal with improves wettability between aluminium alloy and graphite is graudally lowered into the metal with the help of a tong. Magnesium to the extent of 1% of the melt is recommended to achieve wetting. The tongs are also kept moving side ways to ensure proper mixing of magnesium in the melt. The bath is then agitated with a baffle and slag is removed. Melt is now degassed with dry nitrogen gas. The degassing may be done for about 6 minutes. Nitrogen gas should uniformly bubble through the molten metal. After degassing flux is again sprinkled on the surface of the melt, it is worked in and removed. The melt is now ready for addition of graphite. The termperature at this stage should be maintained at around about 700° to about 720° C.

During the period when the metal is charged into the crucible and degassed, the graphite powder gets heated get up in the small crucible. It is necessary that during the melting of aluminium alloy, the graphite particle should reach a temperature of about 900° C. This temperature is reach in about ½ an hour. To ensure this, the crucibles, containing graphite particles, were placed slightly below the top level of the melting crucible, and covered with coke. The graphite powder is, now and then, agitated with the help of a small spoon to achieve uniform heating and to release the volatile matter (pitch) from the powder. Stirrer is than lowered into the crucible containing melt to a distance equal to the radius of the stirrer from the bottom of the curcible. It is located centrally and kept vertical. It is then given the rotatory motion and speed is raised to about 500 to about 600 r.p.m. The lid of the graphite crucible is then removed and addition of graphite particles is started with the help of a spoon. The addition has to be slow and is made on the periphery of the vortex. It is drawn into the metal by the churning action of the stirrer.

The uniform pattern of churning is now and then disturbed by the use of a suitable baffle lowered into the metal against the side of the crucible taking care that it does not hit the moving stirrer blades.

After complete addition of graphite, the stirrer is kept moving for a minute at a lower speed i.e. about 400 r.p.m. Stirrer is then stopped and removed and metal is degassed again for about 2 to 2 ½ minutes. Metal is now ready for casting.

If for any reason graphite is not wetted by aluminium, it will be rejected and will float to the surface. In that case, the rejected graphite is skimmed off and fresh addition of pre-heated graphite is made in the manner similar to that described above. To take care of such an eventuality, two lots of graphite are heated side by side in separate crucibles in the furnace. The entire operation i.e. initial degassing to final degassing, need be carried out in the temperature range of about 700° To about 740° C.

A graphite coated and heated spoon is now used to take out the composite melt for pouring into the moulds. Everytime, before the metal is spooned out, it is agitated by the spoon itself to ensure uniform distribution of wetted graphite. It may be noted that wetted graphite particles as well rise to be surface due to density difference between the graphite particles and aluminium melt and accumulate at the top forming a thick layer. This starts appearing after about 15 to 20 secs. of the mixing of these into the metal. It is therefore necessary always to agitate the molten composite melt everytime before it is spooned out for pouring into the mould. Pouring should be fast.

All the equipment i.e. stirrer, skimmers, plungers, baffle, spoons, etc. are cleaned with graphite. They are then arranged on the periphery of the furnace for drying and heating before use.

Graphite particles, upto about 10 wt.% and size range from about 10 μm to about 300 μm have been used for dispersing in the aluminium alloy. However, the best distribution of particles are achieved when the size range is within about 63 μm to about 125 μm.

It has been observed that eutectic silicon can be modified by addition of sodium element (about 0.5 wt.%) in graphite particle dispersed aluminium-silicon composites. The addition of sodium element should be done before dispersing graphite particles. Microstructural investigation has revealed that sodium added after dispersing graphite particle has no effect on eutectic silicon.

In hypereutectic aluminium-silicon alloys, the first phase to solidify is primary silicon and can be seen as large cuboids. This, in general, weakens the matrix alloy strength. Thus, in order to refine the primary silicon, red phosphorus (about 0.03 wt.%) is added, just after degasification. Immediately, after refinement, the melt is further modified with sodium element (about 0.05 wt.%). Graphite particles should be dispersed, after addition of red phosphorus and sodium, with a view to achieve refined and modified silicons in Al-Si-graphite composites.

Addition of graphite does adversely affect the mechanical properties of the base alloy but the desired properties can be achieved in the composite by adjusting the percentage of graphite and proper selection of the base aluminium-alloy. It, however, improves the tribological behaviour of the composite. It is significant to note that forging, extrusion and heat treatment of the composite can be carried out in the same manner as the base alloy. The normal casting techniques of sand moulding, gravity die casting and pressure die casting are applicable to composite materials.

It has also been observed that during pressure die casting the graphite particles get exfoliated and aluminium enters the voids created between the fragmented parts of the particle. This improves the tensile strength of the component over other casting techniques.

Attempts were made to cast pistons, cylinder blocks, bushing spring guides etc. out of aluminium-graphite composites. Although the fluidity of aluminium alloys decreased with addition of graphite particles, the values of casting fluidity are found to be adequate for making a variety of intricate castings mentioned above.

The most significant advantage of graphitic-aluminium is reduction in weight to one third as compared to cast iron and copper base alloys. This reduces the weight and consequently the fuel consumption of vehicle.

Dispersed graphite particles in aluminium matrices act as a solid lubricant and improve tribological properties.

The process for making aluminium-graphite composite has been made simple and the equipment is so designed as to be within the reach of a small foundry unit.

There is hardly any increase in the cost of composites over that of the base materials.

Components made out of graphitic-aluminium would be cheaper i.e. costing one-third of copper base alloys.

Aluminium alloy-graphite particle composites can successfully be used for pistons, cylinder blocks, bearings, etc.

Resistance to seizure of the composite is very good. It can be run under boundary lubrication without seizing.

Temperature rise in the bearing is reduced by the addition of graphite particles.

Graphite acts as a solid lubricant and reduces wear losses during friction.

Components weighing from a few grams upto about 5 kgs. have been successfully produced out of aluminium-graphite composites.

Intricate shape and thin sections have been successfully cast with ease.

Mechanical strength of the aluminium-graphite composites is lower than the base alloy, however, it is adequate for most application envisaged.

Strength values can be maintained at the desired levels, within limits, by controlling the graphite content.

Machinability is better than the base material.

Machinability is greatly improved by controlled graphite addition to aluminium matrices.

Life and performance of the cutting tool is enhanced.

Addition of graphite particles improves damping capacity of the base alloys.

Aluminium-graphite composite is comparable to grey cast iron which is known for its excellent damping capacity.

The invention is further illustrated with the following examples which should not be considered to limit the scope of the invention:

EXAMPLE I

| | |
|---|---|
| Alloy designation | LM-0 + 3% Graphite |
| Mix | |
| LM-0 | 40 Kgs. |
| Graphite | 1200 gms. |
| magnesium | 400 gms |
| Process Material | |
| Cover flux | 250 gms. |
| Nitrogen gas | |
| (1) Initial degassing | 6 minutes |
| (2) Final degassing | 3 minutes |
| Parameters | |
| Graphite particle size | −125 + 63 micron |
| Graphite surface treatment | heating at 900° C. for 2 hours |
| Degassing temperature | 730–750° C. |
| Stirring temperature | 720–740° C. |
| Pouring temperature | 700–740° C. |
| Stirring speed | 500–600 rpm |
| Properties of the composite so prepared | |
| Tensile strength | 70 MPa |
| Percentage elongation | 4% |
| Hardness (Brinell) | 30 H.B. |
| Specific Gravity | 2.64 |

EXAMPLE-II

| | |
|---|---|
| Alloy designation | LM-13 + 3% Graphite |
| LM-13 | 40 Kgs. |
| Graphite | 1200 gms. |
| Process Material | |
| Cover flux | 250 gms. |
| Nitrogen gas | |
| (1) Initial degassing | 6 minutes |
| (2) Final degassing | 3 minutes |
| Parameters | |
| Graphite particle size | −125 + 63 micron |
| Graphite surface treatment | heating at 900° C. for 2 hours |
| Degassing temperature | 720–740° C. |
| Stirring temperature | 700–720° C. |
| Pouring temperature | 680–720° C. |
| Stirring speed | 500–600 rpm |
| Properties of the composite so prepared | |
| Tensile strength | 190 MPa |
| Percentage elongation | 0.3% |
| Hardness (Brinell) | 120 H.B. |
| Electrical conductivity (% ICAS) | 23% |
| Specific Gravity | 2.6 |

EXAMPLE-II

| | |
|---|---|
| Alloy designation | LM-13 + 5% Graphite |
| LM-13 | 40 Kgs. |
| Graphite | 1200 gms. |
| Process Material | |
| Cover flux | 250 gms. |
| Nitrogen gas | |
| (1) Initial degassing | 6 minutes |
| (2) Final degassing | 3 minutes |
| Parameters | |
| Graphite particle size | −125 + 63 micron |
| Graphite surface treatment | heating at 900° C. for 2 hours. |
| Degassing temperature | 720–740° C. |
| Stirring temperature | 700–720° C. |
| Pouring temperature | 680–720° C. |
| Stirring speed | 500–600 rpm |
| Properties of the composite so prepared | |
| Tensile strength | 155 MPa |
| Percentage elongation | 0.2% |
| Hardness (Brinell) | 102 H.B. |
| Electrical conductivity (% ICAS) | 20% |
| Specific gravity | 2.6 |

EXAMPLE-IV

| | |
|---|---|
| Alloy designation | LM-13 + 5% Graphite (Particle size - 45 micron) Heat treated. |
| Mix | |
| LM-13 | 40 Kgs. |
| Graphite | 1200 gms. |
| Process Material | |
| Cover flux | 250 gms. |
| Nitrogen gas | |
| (1) Initial degassing | 6 minutes |
| (2) Final degassing | 3 minutes |
| Parameters | |
| Graphite particle size | −45 micron |
| Graphite surface treatment | heating at 900° C. for 2 hours. |
| Degassing temperature | 720–740° C. |
| Stirring temperature | 700–720° C. |
| Pouring temperature | 680–720° C. |
| Stirring speed | 500–600 rpm. |

-continued

| | |
|---|---|
| Properties of the composite so prepared | |
| Tensile strength | 145 MPa. |
| Percentage elongation | 0.2% |
| Hardness (Brinell) | 95 H.B. |
| Electrical conductivity (% ICAS) | 20% |
| Specific gravity | 2.6 |

EXAMPLE-V

| | |
|---|---|
| Alloy designation | LM-6 + 3% graphite |
| Mix | |
| LM-6 | 40 Kgs. |
| Graphite | 1200 gms. |
| Magnesium | 400 gms. |
| Process Material | |
| Cover flux | 250 gms. |
| Nitrogen gas | |
| (1) Initial degassing | 6 minutes |
| (2) Final degassing | 3 minutes |
| Parameters | |
| Graphite Particle size | −125 + 63 micron |
| Graphite surface treatment | heating at 900° C. for 2 hours |
| Degassing temperature | 720–740° C. |
| Stirring temperature | 700–720° C. |
| Pouring temperature | 680–720° C. |
| Stirring speed | 500–600 rpm |
| Properties of the composite so prepared | |
| Tensile strength | 125 MPa |
| Percentage elongation | |
| Hardness (Brinell) | 60 H.B. |
| Electrical conductivity (% ICAS) | 30% |
| Specific gravity | 2.64 |

EXAMPLE-VI

| | |
|---|---|
| Alloy designation | LM-13 + 5.5% Graphite (Pressure die cast) |
| Mix | |
| LM-13 | 40 Kgs |
| Graphite | 1200 gms. |
| Process material | |
| Cover flux | 250 gms. |
| Nitrogen gas | |
| (1) Initial degassing | 6 minutes |
| (2) Final degassing | 3 minutes |
| Parameters | |
| Graphite particle size | −125 + 63 micron |
| Graphite surface treatment | heating at 900° C. for 2 hours |
| Degassing temperature | 720–740° C. |
| Stirring temperature | 700–720° C. |
| Pouring temperature | 700–720° C. |
| Stirring speed | 500–600 rpm. |
| Properties of the composite so prepared | |
| Tensile strength | 168 MPa |
| Percentage elongation | 0.9% |
| Hardness (Brinell) | 138 |
| Electrical conductivity (% ICAS) | 20% |
| Specific gravity | 2.64 |

EXAMPLE-VII

| | |
|---|---|
| Alloy designtion | LM-30 + 3% Graphite |
| Mix | |
| LM-30 | 40 Kgs. |
| Graphite | 1200 gms. |

-continued

| | |
|---|---|
| Magnesium | 400 gms. |
| Process material | |
| Cover flux | 250 gms. |
| Nitrogen gas | |
| (1) Initial degassing | 6 minutes |
| (2) Final degassing | 3 minutes |
| Parameters | |
| Graphite particle size | −125 + 63 micron |
| Graphite surface treatment | heating at 900° C. for 2 hours |
| Degassing temperature | 720–740° C. |
| Stirring temperature | 700–720° C. |
| Pouring temperature | 700–720° C. |
| Stirring speed | 500–600 rpm. |
| properties of the composite so prepared | |
| Tensile strength | 100 MPa |
| Percentage elongation | 1 % |
| Electrical conductivity (% ICAS) | 18.4% |
| Specific gravity | 2.6 |

EXAMPLE-VIII

| | |
|---|---|
| Alloy designation | LM-16 + 3% Graphite |
| Mix | |
| LM-16 | 40 Kgs. |
| Graphite | 1200 gms. |
| Magnesium | 400 gms. |
| Process Material | |
| Cover flux | 250 gms. |
| Nitrogen gas | |
| (1) Initial degassing | 6 minutes |
| (2) Final degassing | 3 minutes |
| Parameters | |
| Graphite particle size | −125 + 63 micron |
| Graphite surface treatment | heating at 900° C. for 2 hours. |
| Degassing temperature | 720–740° C. |
| Stirring temperature | 710–730° C. |
| pouring temperature | 710–730° C. |
| Stirring speed | 500–600 rpm. |
| Properties of the composite so prepared | |
| Tensile strength | 145 MPa |
| Percentage elongation | 1% |
| Hardness (Brinell) | 90 H.B. |
| Electrical conductivity (% ICAS) | 26.5% |
| Specific gravity | 2.65 |

EXAMPLE-IX

| | |
|---|---|
| Alloy designation | 2014 + 3% graphite |
| Mix | |
| 2014 | 40 Kgs. |
| Graphite | 1200 gms. |
| Magnesium | 400 gms. |
| Process Material | |
| Cover flux | 250 gms. |
| Nitrogen gas | |
| (1) Initial degassing | 6 minutes |
| (2) Final degassing | 3 minutes |
| Parameters | |
| Graphite particle size | −125 + 63 micron |
| Graphite surface treatment | heating at 900° C. for 2 hours |
| Degassing temperature | 720–740° C |
| Stirring temperature | 710–730° C. |
| Pouring temperature | 710–730° C. |
| Stirring speed | 500–600 rpm |
| Properties of the composite so prepared | |
| Tensile strength | 184 MPa |
| Percentage elongation | 2% |
| Hardness (Brinell) | 130 H.B. |

-continued

| | |
|---|---|
| Electrical conductivity (% ICAS) | 30% |
| Specific gravity | 2.77 |

EXAMPLE-X

| | |
|---|---|
| Alloy designation | 2014 + 3% Natural Graphite |
| Mix | |
| 2014 | 40 Kgs. |
| Graphite | 1200 gms. |
| Magnesium | 400 gms. |
| Process Material | |
| Cover flux | 250 gms. |
| Nitrogen gas | |
| (1) Initial degassing | 6 minutes |
| (2) Final degassing | 3 minutes |
| Parameters | |
| Graphite particle size | −125 + 63 micron |
| Graphite surface treatment | heating at 900° C. for 2 hours |
| Degassing temperature | 720–740° C. |
| Stirring temperature | 710–730° C. |
| pouring temperature | 710–730° C. |
| Stirring speed | 500–600 rpm. |
| Properties of the composite so prepared | |
| Tensile strength | 138 MPa |
| Percentage elongation | 0.7% |
| Hardness (Brinell) | 77 H.B. |
| Electiical conductivity (% ICAS) | 35.2 |
| Specific gravity | 2.76 |

We claim:

1. A process for the manufacture of aluminium-graphite composite using uncoated graphite particles for automobile and engineering applications which comprises melting aluminium alloy in a furnace, adding a flux to cover the molten aluminium alloy, treating the molten aluminium alloy with a reactive metal to increase the wettability of the alloy and graphite particles, mixing the molten aluminium alloy for the proper distribution of the reactive metal, cleaning and degassing the molten aluminium alloy with dry nitrogen to remove aluminium oxide and dissolved hydrogen gas, treating the molten aluminium alloy thereafter with flux and gradually adding surface activated graphite powder to the bath and stirring at about 500 to about 600 rpm at a temperature of about 700° to about 730 ° C.

2. A process as claimed in claim 1, wherein the aluminium alloy is selected from the group consisting of aluminium-silicon, aluminium-copper, aluminium-silicon-copper and aluminium-silicon-copper-magnesium alloys.

3. A process as claimed in claim 2 wherein the aluminium alloy is a British Standard Institution aluminium alloy selected from the group consisting of LM-O, LM-13, LM-16, LM-16, LM-4, LM-29, LM-13 and LM-10.

4. A process as claimed in claim 1, wherein the reactive metal is selected from the group consisting of magnesium, strontium, titanium and lead.

5. A process as claimed in claim 4, wherein the reactive metal employed is about 1% by weight of the alloy.

6. A process as claimed in claim 1, wherein the degassing with dry nitrogen is for about 6 minutes.

7. A process as claimed claim 1, wherein the temperature of the bath is maintained at about 700 degrees to about 740 degrees C. subsequent to degassing.

8. A process as claimed in claim 1, wherein the graphite particles are surface activated by heating to about 900 degrees C. for about 2 to about 3 hours.

9. A process as claimed in claim 1, wherein the melting of the alloy and addition of graphite particles are performed in the same furnace.

10. A process as claimed in claim 9, wherein melting of the alloy is carried out in a graphite crucible and the heating of graphite is carried out in a graphite crucible.

11. A process as claimed in claim 1, wherein the furnace employed is either an oil, coal, fired or an electric furnace.

12. A process as claimed in claim 11, wherein aluminium alloy containing large amount of silicon is pretreated by adding sodium metal before addition of the pre-heated graphite.

* * * * *